US005948308A

United States Patent [19]

Wischusen, III

[11] Patent Number: 5,948,308

[45] Date of Patent: Sep. 7, 1999

[54] FOOD PRODUCT TRAY WITH EXPANDABLE SIDE PANELS

[75] Inventor: Henry Wischusen, III, Lilburn, Ga.

[73] Assignee: Rock-Tenn Company, Norcross, Ga.

[21] Appl. No.: 08/955,642

[22] Filed: Oct. 22, 1997

[51] Int. Cl.[6] ..... H05B 6/80

[52] U.S. Cl. ..... 219/730; 229/903

[58] Field of Search ..... 219/730, 732, 219/759; 426/107, 241, 243, 234; 99/DIG. 14; 229/903, 195, 109, 110, 123

[56] References Cited

U.S. PATENT DOCUMENTS

| | | | |
|---|---|---|---|
| 546,767 | 9/1895 | Knobeloch . | |
| 742,159 | 10/1903 | Burton . | |
| 1,075,812 | 10/1913 | Brashear . | |
| 1,352,833 | 9/1920 | Robinson . | |
| 3,038,463 | 6/1962 | Daymon . | |
| 3,393,859 | 7/1968 | Giummo | 229/195 |
| 3,608,811 | 9/1971 | Frick . | |
| 3,902,653 | 9/1975 | Persson . | |
| 3,941,967 | 3/1976 | Sumi et al. . | |
| 4,190,757 | 2/1980 | Turpin et al. . | |
| 4,248,901 | 2/1981 | Austin . | |
| 4,361,227 | 11/1982 | Paulucci . | |
| 4,453,665 | 6/1984 | Roccaforte et al. . | |
| 4,571,340 | 2/1986 | Ferrante et al. . | |
| 4,877,932 | 10/1989 | Bernstein et al. . | |
| 4,891,482 | 1/1990 | Jaeger et al. . | |
| 4,940,867 | 7/1990 | Peleg . | |
| 5,077,455 | 12/1991 | Peleg et al. . | |
| 5,153,402 | 10/1992 | Quick et al. . | |
| 5,247,149 | 9/1993 | Peleg . | |
| 5,300,746 | 4/1994 | Walters et al. . | |
| 5,484,984 | 1/1996 | Gics . | |

FOREIGN PATENT DOCUMENTS

| | | |
|---|---|---|
| 513277 | 10/1952 | Belgium . |
| 475809 | 8/1951 | Canada . |
| 60955 | 7/1941 | Denmark . |

*Primary Examiner*—Teresa Walberg
*Assistant Examiner*—Jeffrey Pwu
*Attorney, Agent, or Firm*—Jones & Askew, LLP

[57] ABSTRACT

An improved food product tray for storing, cooking and serving food products. The food product tray is used to store, cook and serve a food product without assembly or disassembly by the end user. The food product tray includes a floor or base panel and a plurality of upright side panels which enclose the food product. A tab/slot configuration allows the upright side panels to expand outwardly from a first position to a second position as the food product expands during cooking. The base panel may include legs to elevate the base panel, and the base panel may include a plurality of vents to release fluids and gases from the food product. The interior surfaces of the base panel and upright side panels may include microwave absorbent material to enhance cooking of the food product using microwave energy.

15 Claims, 5 Drawing Sheets

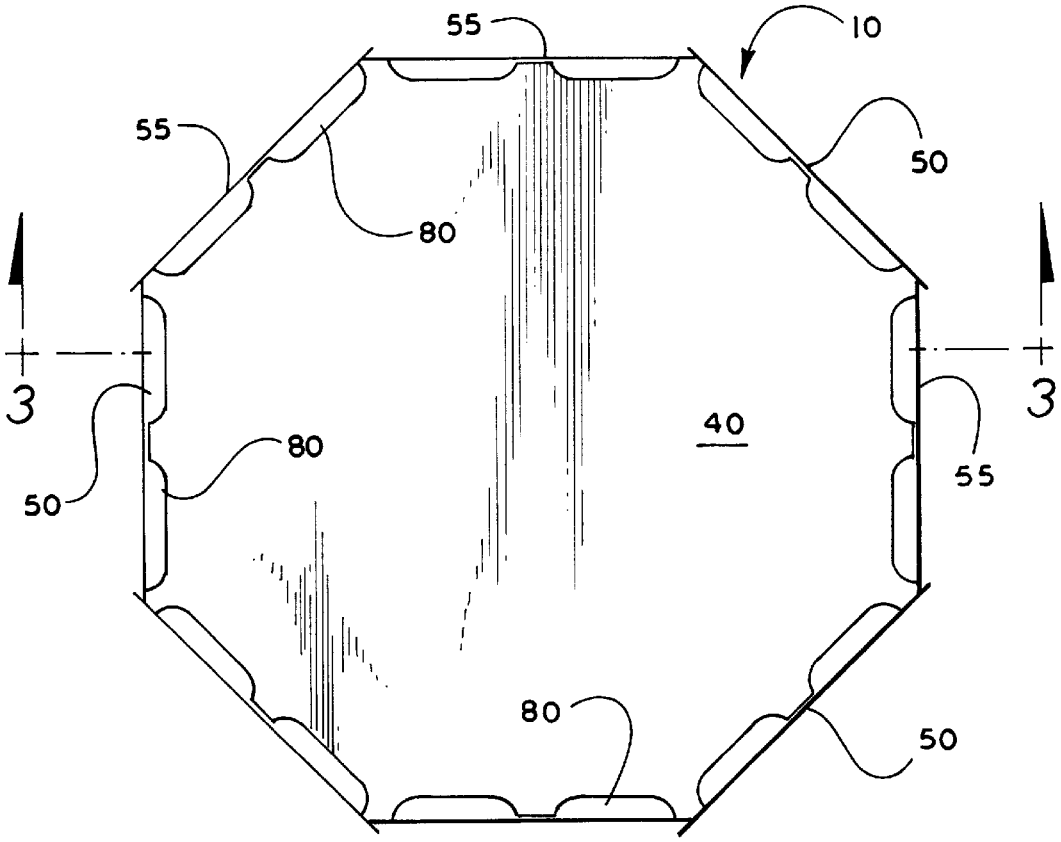
Fig. 2
Fig. 3
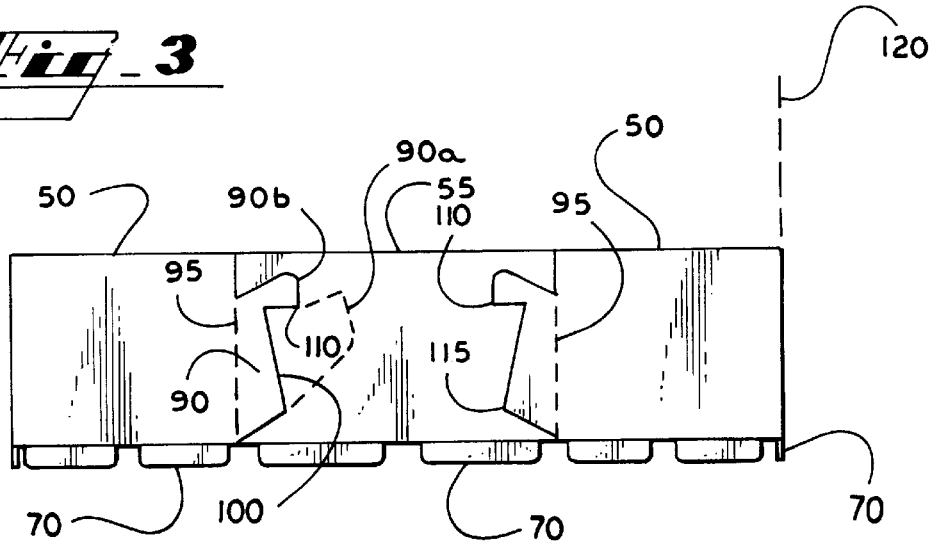

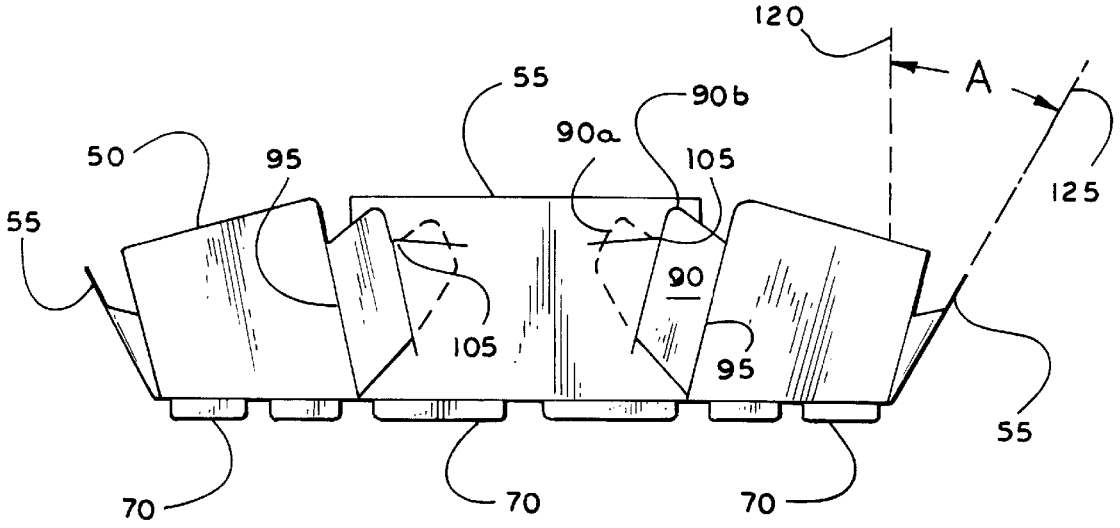
Fig. 4
Fig. 5
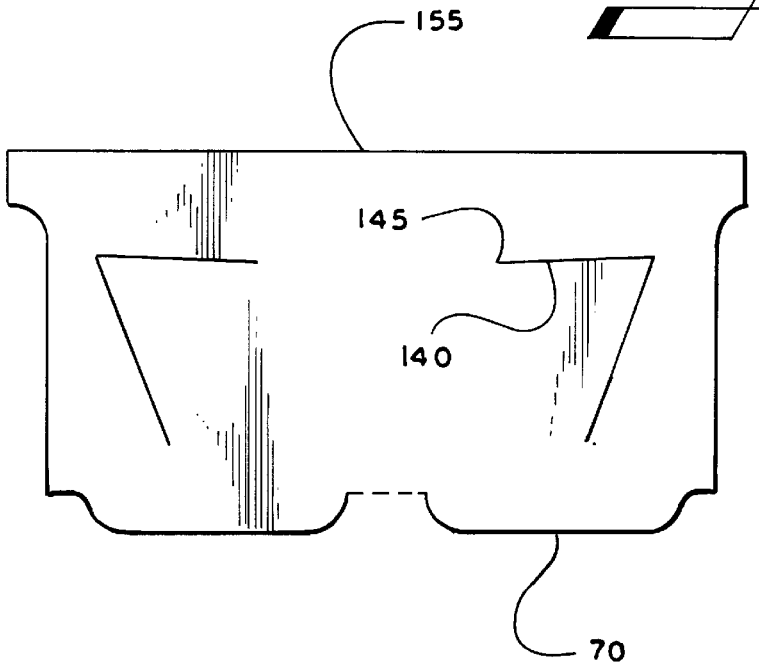

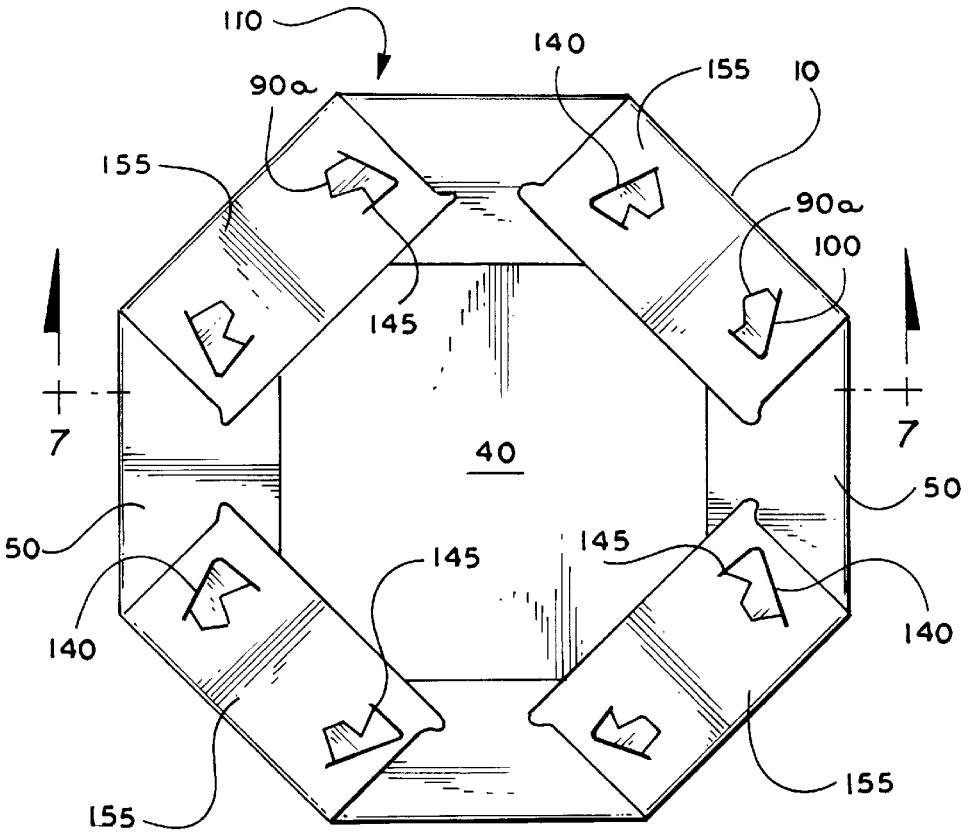
Fig. 6
Fig. 7
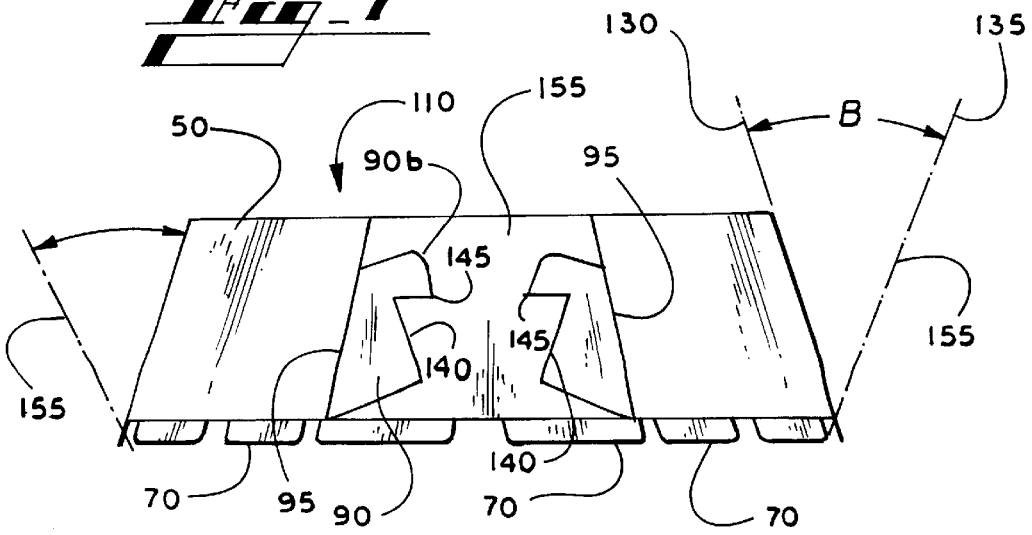

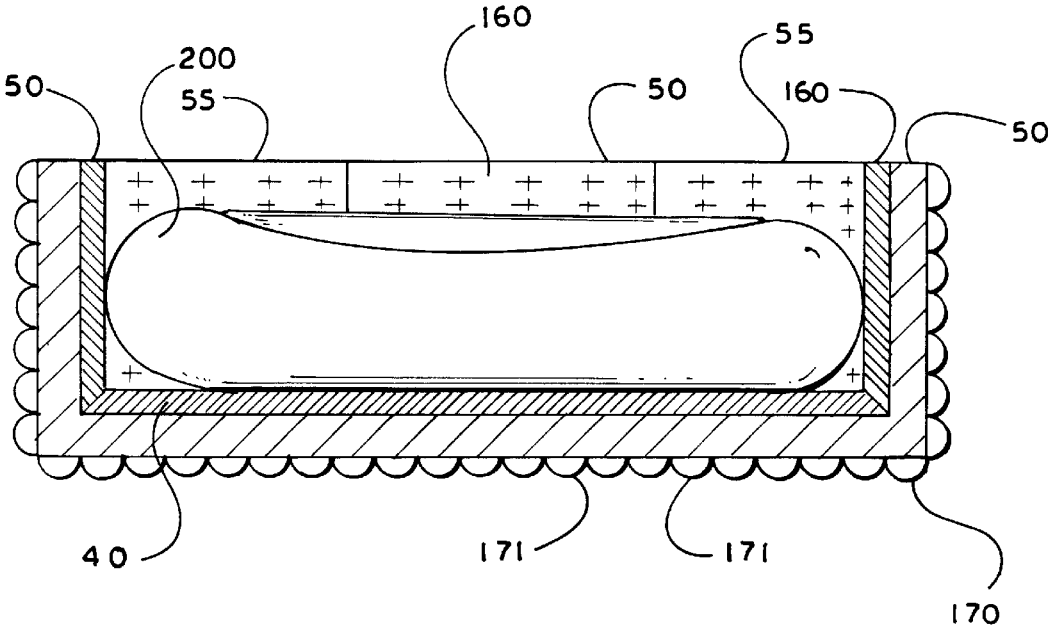
Fig. 8
Fig. 9
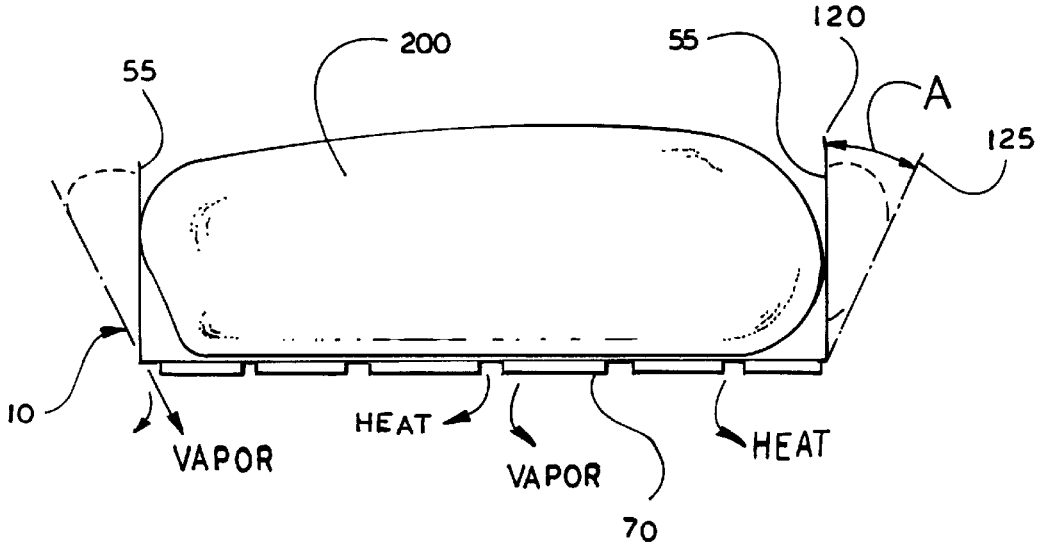

FOOD PRODUCT TRAY WITH EXPANDABLE SIDE PANELS

FIELD OF THE INVENTION

This invention relates in general to a tray for storing, cooking, and serving foods, and more particularly relates to a food product tray with interlocking upright side panels which may expand outwardly as a food product expands during cooking.

BACKGROUND OF THE INVENTION

In recent years, the packaging industry has responded to the ever increasing use of processed and ready-to-cook foods by providing a variety of food product packages which may be used for storing, cooking, and serving food products. With the advent of microwave cooking technology, microwaveable food product packages have been developed which may be used to contain a food product during microwave cooking and which may be used to enhance cooking of the food product contained therein.

A microwave cooking appliance is disclosed in U.S. Pat. No. 5,247,149. The microwave cooking appliance discloses an octagonal-shaped susceptor base and a plurality of heat tabs positioned at acute angles over the susceptor base. Each heat tab may be locked to an adjacent heat tab using a locking device which locks the heat tabs into an operating position at an acute angle above the surface of the susceptor base.

A disposable microwave heating receptacle is disclosed in U.S. Pat. No. 4,891,482. The disposable receptacle has a self-supporting configuration for combined baking and cooking of a generally flat food article, such as a pizza The disposable receptacle is formed of a self-supporting sleeve or box to surround a food article. The lower portion of the food product is heated primarily by conduction while the upper portion of the food article is heated by combined radiation from heated microwave susceptor material and microwave energy absorption.

In those systems, a food product is contained in a sleeve or box or underneath a plurality of locked heating tabs. Thus, the end user must tear away the heating tabs or box in order to retrieve the cooked food product. Also, those systems confine the food product and do not allow for lateral expansion of the food product during cooking.

Thus, there is a need in the art for a food product tray that can be used to store, cook, and serve a food product. There is further need in the art for a food product tray which will expand as the food product expands during cooking. There is also a need in the art for a microwaveable cooking tray with expandable upright side panels where the interior of the tray is lined with microwave susceptor material to enhance cooking of the food product.

SUMMARY OF THE INVENTION

The present invention seeks to provide an improved food product tray for storing, cooking and serving food products. The present invention allows a food product to be stored, cooked and served without assembly or disassembly of the food product tray by the end user. Generally, the food product tray of the present invention includes a floor or base panel and upright side panels which may be used to support, contain and cook a food product. A tab/slot configuration allows the upright side panels to expand outwardly as the food product expands during cooking. The interior surfaces of the base panel and upright side panels may be lined with microwave susceptor material to enhance cooking of the food product using microwave energy.

More particularly, one aspect of the present invention provides a tray formed from a unitary blank for storing, cooking and serving food products. The tray includes a base panel, a plurality of side panels foldably connected to the base panel and adjacent to one another. Each pair of adjacent side panels are slidably connected by a tab defined on one of the pair extending into a slot on the adjacent one of the pair so as to permit angular movement of the side panels from a first position relative to the base panel to a second position spaced angularly outwardly from the first position. Preferably the tab includes a first tab catch and a second tab catch, and the slot includes a tab stop. The side panels preferably are stopped at the first position by engagement of the first tab catch with the tab stop, and the side panels preferably are stopped at the second position by engagement of the second tab catch with the tab stop. The first position preferably is substantially perpendicular to the base panel. Alternatively, the first position is at an acute angle relative to the base panel. The second position preferably is at an obtuse angle relative to the base panel.

The base panel may comprise a plurality of vents for releasing fluids and gases. The base panel may comprise a plurality of legs disposed along a bottom surface of the base panel for elevating the base panel above a support surface on which the tray is supported. Alternatively the base panel may comprise a corrugated paper layer disposed along a bottom surface of the base panel for elevating the base panel above a support surface on which the tray is supported. The side panels may also comprise a corrugated paper layer disposed along a bottom surface of the side panels. The floor panels and the side panels may be capable of becoming hot upon absorption of microwaves. The base panel may be generally octagonal.

Thus it is an object of the present invention to provide an improved microwaveable food product tray for storing, cooking and serving a food product. Other objects, features, and advantages of the present invention will become apparent upon review of the following description of the preferred embodiments and the appended drawings and claims.

BRIEF DESCRIPTION OF DRAWINGS

FIG. 2 is a top plan view of the food product tray of FIG. 1 showing the side panels in an upright configuration.

FIG. 3 is a side elevation cross-sectional view of the food product tray of FIG. 2, taken along lines 3—3 showing connection of adjacent upright side panels.

FIG. 4 is a side elevation cross-sectional view of the food product tray of FIG. 3 showing the adjacent upright side panels in an expanded configuration.

FIG. 5 is a side elevation view of a slotted side panel showing an alternate slot embodiment.

FIG. 6 is a top plan view of the food product tray according to an alternative embodiment showing the side panels in an upright configuration and angled inward over the base panel.

FIG. 7 is a side elevation cross-sectional view of the-food product tray of FIG. 6, taken along lines 7—7 showing connection of adjacent upright side panels with the side panels angled inward.

FIG. 8 is a side elevation cross-sectional view of an alternate embodiment of a food product tray showing a cross-sectional view of an uncooked pizza pie supported therein and showing microwave susceptor material disposed on the interior surfaces of the tray and showing a corrugated paper layer disposed on the bottom surface of the base panel of the tray.

FIG. 9 is a side elevation cross-sectional view of the food product tray of FIG. 2 showing (in phantom) the upright side panels of the food product tray in an expanded configuration in response to an expanded cooked pizza pie.

DETAILED DESCRIPTION

Figure 1:
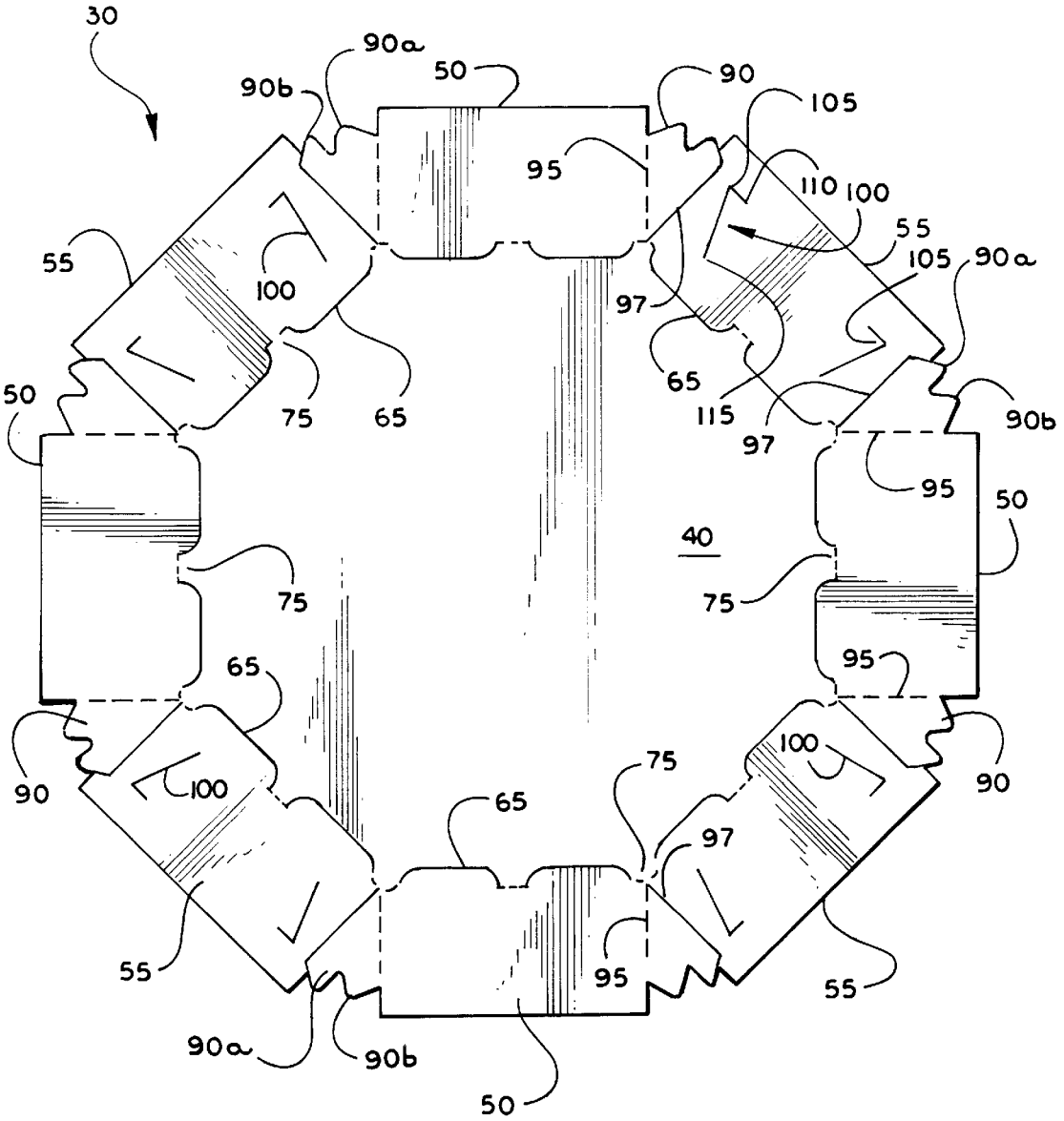
FIG. 1 is a top plan view of a blank of a food product tray embodying the present invention, showing a floor panel and foldable side panels with connector tabs and slots in adjacent side panels for connecting the side panels in an upright configuration.

Referring now in more detail to the drawings in which like numerals refer to like parts throughout the several views, FIGS. 1 and 9 show a food product tray 10 embodying the present invention. The food product tray 10 may be used to store and serve a food product 200, and the food product tray 10 may be used to cook a food product 200 using microwave and conventional cooking methods. With reference to FIGS. 1, 2, 3 and 9 the food product tray 10 includes abase panel 40 and a plurality of alternating side panels 50 and 55 for enclosing and supporting a food product 200. A tab/slot configuration is used to connect adjacent side panels 50 and 55 when the food product tray 10 is constructed. The tab/slot configuration allows the side walls to be compressed inwardly or expanded to a vertical or outward leaning configuration without disconnecting the side panels 50 and 55 from each other. The side panels 50 and 55 may expand outwardly as the food product expands during cooking. If desired, the interior surfaces of the base panel 40 and side panels 50 and 55 may be lined with a microwave susceptor material which will become hot upon absorption of microwave energy. Accordingly, the interior surfaces of base panel 40 and side panels 50 and 55 may be used to enhance cooking of the food product 200. The subassemblies thus far noted will now be described in detail.

The food product tray 10 of the present invention is preferably constructed from a unitary blank 30 as shown in FIG. 1. Preferably, the unitary blank 30 is die cut from paperboard stock using conventionally known methods. The unitary blank 30 includes a generally octagonal base panel 40 and has a plurality of side panels 50 and 55 connected to the eight edges of the octagonal base panel 40 along cut lines 65 and fold lines 75. As shown in FIG. 1, a tab 90 is foldably connected along fold lines 95 to opposing sides of each of the tabbed side panels 50 and adjacent to the slotted side panels 55. The tabs 90 are separated from the slotted side panels 55 along cut lines 97 in the unitary blank 30. Each of the slotted side panels 55 includes two opposing slots 100 for receiving the tabs 90, as is discussed in detail below.

As shown in FIG. 1, each of the tabs 90 define a forward tab catch **90*a* and a rear tab catch 90*b* for operatively engaging slots 100 defined on opposite sides of the slotted side panels 55. The slots 100 are cut into the slotted side panels 55 in a generally inverted L-shape as shown in FIG. 1. The slots 100 define a vertex 105 and an upper tab stop 110 and lower tab stop 115 at the upper and lower terminations, respectively, of the cut lines forming the slots 100**.

In order to construct the food product tray 10, the tabbed side panels 50 and the slotted side panels 55 are folded along fold lines 75 to an upright position approximately 90 degrees off the horizontal base panel 40. As the tabbed side panels 50 and slotted side panels 55 are folded to an upright position, the forward tab catch **90*a* of the tab 90 of each tabbed side panel 50 is inserted into a corresponding slot 100 of each adjacently disposed slotted side panel 55, as shown in FIG. 3. Accordingly, each tabbed side panel 50 is connected to each adjacent slotted side panel 55 to form the food product tray 10 with the tabbed side panels 50 and slotted side panels 55 configured approximately perpendicular to the base panel 40, as shown in FIG. 2**.

In the preferred embodiment shown in FIGS. 3 and 4, the tab/slot configuration allows the side panels 50 and 55 to move angularly outward from a first position 120 perpendicular to the base panel 40 to a second position 125. Preferably, the angle "A" between the first position 120 and the second position 125 is on the order of 25 degrees such that the first position is preferably 90 degrees off the horizontal base and the second position is on the order of 115 degrees off the horizontal base panel 40. In the preferred embodiment, the tab/slot configuration prevents the side panels 50 and 55 from moving angularly inward toward the base panel 40 past a position perpendicular to the base panel 40, as described in detail below. This configuration prevents collapse of the side panels 50 and 55 of the food product tray 10 onto the food product 200 and thereby protects the upper surface of the food product 200 from damage during shipment, storage or cooking.

Referring now to FIGS. 1, 3 and 4, movement of the side panels 50 and 55 from a first position 120 angularly outward to a second position 125 is facilitated by the action of the tabs 90 of the tabbed side panels 50 with the slots 100 of the slotted side panels 55. As shown in FIG. 3, when the side panels 50 and 55 are in an upright configuration perpendicular to the base panel 40, the forward tab catch **90*a* (shown in phantom in FIG. 3) is inserted into an adjacent slot 100 until the rear tab catch 90*b* of the tab 90 is stopped against the upper tab stop 110 of the slot 100. The contact between the rear tab catch 90*b* with the upper tab stop 110 of the slot 100 prevents additional insertion of the tab 90 into the slot 100, and accordingly prevents the side panels 50 and 55 from moving angularly inward toward the base panel 40 of the food product tray 10**, as discussed above.

As shown in FIG. 4, movement of the side panels 50 and 55 angularly outward from the first position 120 to the second position 125 also is permitted by the tab/slot configuration. As shown in FIG. 4, as the side panels 50 and 55 move angularly outward toward the second position 125, the tab 90 is retracted from the slot 100 until the forward tab catch **90*a* catches on the vertex 105 of the L-shaped slot 100. It should be understood that the angle "A" corresponding to the outward movement of the side panels 50 and 55 may be readily adjusted by altering the point at which the forward tab catch 90*a* contacts the vertex 105 of the slots 100**.

Referring to FIGS. 1, 2, and 3, a plurality of legs 70 are provided for elevating the base panel 40 of the food product tray 10 from a cooking surface used during cooking operations. The legs 70 also serve to allow circulation of hot air underneath the food product tray 10 during cooking operations. The legs 70 are formed along the bottom edges of the side panels 50 and 55. As the side panels 50 and 55 are folded along fold lines 75 into an upright position, as described above, the legs 70 are folded underneath the base panel 40 of the food product tray 10, as shown in FIG. 3. It should be understood, however, that the food product tray 10 may be constructed without legs 70 by replacing the fold lines 75 and cut line 70 with a single fold line (not shown) across the lower edge of each of the side panels 50 and 55. As shown in FIG. 2, vents 80 are formed from the folding of the legs 70 into a downward position. It should be understood that the vents 80 allow for the escape of fluids and gases from the cooking food product 200 supported by the food product tray 10 during cooking operations.

In an alternate form of the present invention, as shown in FIG. 8, a corrugated base plate 170 may be adhered to the lower surfaces of the base panel 40 and side panels 50 and 55. The flutes 171 of the corrugated base plate 170 extend downwardly to elevate the food product tray 10 from a cooking surface and to allow circulation of hot air beneath the tray, as described for the legs 70, described above.

Referring now to FIGS. 5, 6 and 7, an alternate embodiment of the present invention is disclosed. In the alternate embodiment of the present invention, a tray 110 includes side panels 50 and 155 configured to move angularly inward toward the base panel 40 to a first position 130, as shown in FIG. 7. Accordingly, in this embodiment of the present invention, the angular movement of the side panels 50 and 155 is characterized by the angle "β," shown in FIG. 7, from a first position 130 out to a second position 135. To facilitate movement of the side panels 50 and 155 angularly inward to the first position 130, an alternate slot 140 is provided in place of the slot 100 of the first embodiment, as shown in FIG. 5. As shown in FIGS. 5 and 7, the alternate slot 140 includes an upper tab stop 145 which extends farther toward the center of the slotted side panel 155. As shown in FIG. 7, this configuration allows the tabs 90 to be inserted farther into the alternate slots 140 until the rear tab catch **90*b* stops against the upper tab stop 145. Accordingly, the side panels may move angularly inward past the perpendicular toward the base panel 40 of the food product tray 10**.

The outward movement of the side panels 50 and 155 to the second position 140 is as described above for the first embodiment. That is, the outward movement to the second position 140 is stopped by the catching of the forward tab catch **90*a* on the vertex of the L-shaped slot 140, as shown in FIG. 4. FIG. 6 is a top plan view of this embodiment of the present invention and shows the side panels 50 and 155 folded angularly inward toward the base panel 40 to the first position 130**.

As illustrated in FIG. 8, the food product tray 10 of the preferred and alternate embodiments of the present invention may include a microwave absorbent material 160 laminated to the upper surfaces of the base panel 40 and side panels 50 and 55. As is well known to those skilled in the art, the microwave absorbent material 160 will become heated upon absorption of microwave energy and may be used in the present invention to enhance cooking of the food product 200 supported by the food product tray 10.

OPERATION

It is useful to describe the operation of the food product tray 10 as it is used during the cooking of an exemplary food product 200. It should be understood that the following exemplary operation is described in terms of the first embodiment described above, and that this exemplary operation applies similarly to the alternate food product tray 110. In use, a food product 200, such as a frozen, refrigerated, pre-cooked or uncooked pizza, uncooked bread or cookie dough, is placed in the food product tray 10, as shown in FIG. 9. It should be understood, the food product 200 may be placed in the food product tray 10 immediately following the manufacturing and preparation of the food product 200. Accordingly, the food product tray 10 may be used to ship and store the food product 200. It should also be understood that the food product tray 10 containing the food product 200 may be placed in a protective packaging such as a pouch or carton and may be shipped to regular marketing outlets such as grocery stores, convenience stores, etc. for purchase by end users.

The food product tray 10 containing the food product 200 may be cooked in a cooking apparatus, such as a microwave cooking oven. As the food product expands during cooking, the side panels 50 and 55 of the food product tray 10 will expand from a first position 120 to the second position 125, as illustrated in FIGS. 4 and 9. Accordingly, the expandable side panels 50 and 55 of the food product tray 10 support the food product 200 during the cooking process and allow the food product 200 to expand without destroying the food product tray 10. Likewise, the expansion of the side panels 50 and 55 prevents the food product 200 from conforming to the interior shape of the food product tray 10 as it is defined by the first position 120 of the side panels 50 and 55. As illustrated in FIGS. 2 and 9, heat and moisture generated by the cooking of the food product 200 may escape through the vents 80 located around the circumference of the base panel 40.

After cooking the food product 200 in the food product tray 10, as described, the food product tray 10 may be used as a convenient serving container for the cooked food product 200.

While the present invention in its various aspects have been described in detail with regard to preferred embodiments thereof, it should be understood that variations, modifications, and enhancements may be made to the disclosed apparatus and procedures without departing from the spirit and scope of the present invention as defined in the appended claims.

What is claimed is:

1. A tray formed from a unitary blank for storing, cooking and serving food products, said tray comprising:

a base panel;

a plurality of side panels foldably connected to said base panel and adjacent to one another;

each pair of adjacent side panels being slidably connected by a tab defined on one of said pair extending into a slot on the adjacent one of said pair said tab having a first tab catch and a second tab catch;

said slot having a tab stop whereby said side panels are permitted to move from a first position relative to said base panel to a second position spaced angularly outward from said first position, said second position being at an obtuse angle relative to said base panel; and whereby said side panels are stopped at said first position by engagement of said first tab catch with said tab stop, and whereby said side panels are stopped at said second position by engagement of said second tab catch with said tab stop.

2. The tray of claim 1, wherein said first position is substantially perpendicular to said base panel.

3. The tray of claim 1, wherein said first position is at an acute angle relative to said base panel.

4. The tray of claim 1, wherein said base panel comprises a plurality of vents for releasing fluids and gases.

5. The tray of claim 1, wherein said base panel comprises a plurality of legs disposed along a bottom surface of said base panel for elevating said base panel above a support surface on which said tray is supported.

6. The tray of claim 1, wherein said base panel comprises a corrugated paper layer disposed along a bottom surface of said base panel for elevating said base panel above a support surface on which said tray is supported.

7. The tray of claim 6, wherein said side panels comprise a corrugated paper layer disposed along a bottom surface of said side panels.

8. The tray of claim 1, wherein said floor panel and said side panels are capable becoming hot upon absorption of microwaves.

9. The tray of claim 1, wherein said base panel is generally octagonal-shaped.

10. A tray for supporting a food product to be cooked using microwaves, comprising:

a microwave absorbing floor panel;

a plurality of microwave absorbing side panels foldably connected to said floor panel and adjacent to one another;

said floor and side panels being capable of becoming hot on exposure to microwaves;

each pair of adjacent side panels being slidably connected by a tab defined on one of said pair extending into a slot on the adjacent one of said pair;

said tab having a first tab catch and a second tab catch;

said slot having a tab stop;

whereby said side panels are permitted to move from a first position relative to said base panel to a second position spaced angularly outward from said first position, said second position being at an obtuse angle relative to said base panel; and whereby said side panels are stopped at said first position by engagement of said first tab catch with said tab stop, and whereby said side panels are stopped at said second position by engagement of said second tab catch with said tab stop.

11. The tray of claim 10, wherein said first position is substantially perpendicular to said floor panel.

12. The tray of claim 10, wherein said first position is at an acute angle relative to said floor panel.

13. A tray formed from a unitary blank for storing, cooking and serving a food product, said tray comprising:

a base panel;

a plurality of side panels foldably connected to said base panel and adjacent to one another;

each pair of adjacent side panels being slidably connected by a tab defined on one of said pair extending into a slot on the adjacent one of said pair;

said tab having a first tab catch and a second tab catch;

said slot having a tab stop;

whereby said side panels are permitted to move from a first position relative to said base panel to a second position spaced angularly outward from said first position, said second position being at an obtuse angle relative to said base panel, said movement of said side panels for allowing lateral expansion of said food product during cooking; and whereby said side panels are stopped at said first position by engagement of said first tab catch with said tab stop, and whereby said side panels are stopped at said second position by engagement of said second tab catch with said tab stop.

14. The tray of claim 13, wherein said first position is substantially perpendicular to said base panel.

15. The tray of claim 13, wherein said first position is at an acute angle relative to said base panel.

* * * * *